US011145247B2

(12) United States Patent
Jiang et al.

(10) Patent No.: US 11,145,247 B2
(45) Date of Patent: Oct. 12, 2021

(54) DEVICE, SYSTEM AND METHOD FOR DISPLAY GAMMA CORRECTION

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Xue Jiang, Beijing (CN); Wei He, Beijing (CN); Zhiyong Yang, Beijing (CN); Jing Wang, Beijing (CN); Liwei Huang, Beijing (CN); Xiaohong Chen, Beijing (CN); Lihong Wu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 50 days.

(21) Appl. No.: 16/642,361

(22) PCT Filed: Aug. 12, 2019

(86) PCT No.: PCT/CN2019/100184
§ 371 (c)(1),
(2) Date: Feb. 26, 2020

(87) PCT Pub. No.: WO2020/103498
PCT Pub. Date: May 28, 2020

(65) Prior Publication Data

US 2021/0150987 A1 May 20, 2021

(30) Foreign Application Priority Data

Nov. 20, 2018 (CN) ..... 201811386499.9

(51) Int. Cl.
*G09G 3/3225* (2016.01)

(52) U.S. Cl.
CPC ... *G09G 3/3225* (2013.01); *G09G 2320/0276* (2013.01); *G09G 2320/0673* (2013.01); *G09G 2360/145* (2013.01)

(58) Field of Classification Search
CPC ... G09G 2320/0271; G09G 2320/0276; G09G 2320/0673
See application file for complete search history.

(56) References Cited

U.S. PATENT DOCUMENTS 8,120,561 B2 * 2/2012 Kudo ..... G09G 3/3688 345/89
9,837,045 B2 * 12/2017 Furihata ..... G09G 3/36
(Continued)

OTHER PUBLICATIONS

International Search Report in Application No. PCT/CN2019/100184, dated Nov. 13, 2019.

*Primary Examiner* — Patrick F Marinelli
(74) *Attorney, Agent, or Firm* — Syncoda LLC; Feng Ma

(57) ABSTRACT

A display module Gamma correction method includes: obtaining corrected Gamma register values corresponding to binding points of a grayscale by correcting register values of s binding points selected from a set of m binding points of the grayscale based on a group of initial Gamma register values that correspond to the m binding points and a target Gamma curve; selecting, from x sets of alternate Gamma register values wherein each set corresponds to m binding points and the initial Gamma register values, a set of Gamma register values used for Gamma correction of the display module(s) as reference register values; and; and correcting register values of remaining m−s binding points based on the reference Gamma register values and the target Gamma curve to obtain a set of target Gamma register values
(Continued)

corresponding to the m binding points, wherein s, m and x are all integers greater than one.

20 Claims, 6 Drawing Sheets

(56) References Cited

U.S. PATENT DOCUMENTS

| | | | | |
|---|---|---|---|---|
| 9,886,779 | B2 * | 2/2018 | Nose | G09G 5/04 |
| 9,886,885 | B2 * | 2/2018 | Kim | G09G 3/2007 |
| 10,269,286 | B2 * | 4/2019 | Zhang | G09G 3/2074 |
| 10,380,936 | B2 * | 8/2019 | Nose | G09G 5/04 |
| 10,460,655 | B2 * | 10/2019 | Zhang | H04N 9/69 |
| 10,839,772 | B2 * | 11/2020 | Hyun | G09G 5/02 |
| 10,930,190 | B2 * | 2/2021 | Wang | G09G 3/20 |
| 2009/0184985 | A1 * | 7/2009 | Kudo | G09G 3/3696 345/690 |
| 2015/0228215 | A1 * | 8/2015 | Nose | G09G 5/04 345/590 |
| 2015/0302788 | A1 * | 10/2015 | Kim | G09G 3/2007 345/690 |
| 2016/0035293 | A1 * | 2/2016 | Furihata | G09G 5/02 345/694 |
| 2016/0335964 | A1 * | 11/2016 | Tang | G09G 3/3611 |
| 2017/0278448 | A1 * | 9/2017 | Zhang | G09G 3/2074 |
| 2018/0158214 | A1 * | 6/2018 | Nose | G09G 5/06 |
| 2019/0051235 | A1 * | 2/2019 | Zhang | H04N 1/60 |
| 2019/0304403 | A1 * | 10/2019 | Hyun | G09G 5/10 |
| 2020/0051478 | A1 * | 2/2020 | Wang | G09G 3/20 |
| 2020/0286423 | A1 * | 9/2020 | Yu | G09G 3/3208 |
| 2021/0049947 | A1 * | 2/2021 | Tian | G09G 3/3225 |

* cited by examiner

DEVICE, SYSTEM AND METHOD FOR DISPLAY GAMMA CORRECTION

CROSS-REFERENCE TO RELATED APPLICATIONS

The present application is a national stage of International Application No. PCT/CN2019/100184, which claims priority to Chinese Patent Application No. 201811386499.9 filed on Nov. 20, 2018. The disclosures of these applications are hereby incorporated by reference in their entirety.

TECHNICAL FIELD

The present disclosure relates to the field of display technologies, and, in particular, to a Gamma correction method and device for a display module.

BACKGROUND

With the advancement of display technologies, users have higher and higher expectations regarding the color, contrast, screen ratio, response speed and other performance metrics of display devices. Taking AMOLED (Active Matrix Organic Light-Emitting Diode) display devices as an example, they are now widely used in more and more electronic products because of their bright color, high contrast, faster response and energy efficiencies.

SUMMARY

The present disclosure provides a Gamma correction method and apparatus for Gamma correction in a display module. Apparatus and methods disclosed herein are used to solve the problem that Gamma correction time is long due to suboptimal choices of initial Gamma register values.

In order to achieve the above object, embodiments of the present disclosure adopt the following technical solutions.

In a first aspect, there is provided a display module Gamma correction method.

Methods in accordance with this aspect generally include the steps of:

obtaining corrected Gamma register values corresponding to binding points of a grayscale by correcting register values of s binding points selected from a set of m binding points of the grayscale based on a group of initial Gamma register values that correspond to the m binding points and a target Gamma curve;

selecting, from x sets of alternate Gamma register values wherein each set corresponds to m binding points and the initial Gamma register values, a set of Gamma register values used for Gamma correction of the display module(s) as reference register values; and correcting register values of remaining (m−s) binding points based on the reference Gamma register values and the target Gamma curve to obtain a set of target Gamma register values corresponding to the m binding points, wherein s, m and x are all integers greater than one.

In some embodiments, the step of selecting, from x sets of alternate Gamma register values wherein each set corresponds to m binding points and the initial Gamma register values, a set of Gamma register values used for Gamma correction of the display module(s) as the reference register values includes:

Selecting, from the x sets of alternate Gamma register values, a set that is closest to the corrected Gamma values as a set of optimal Gamma register values;

using the set of optimal Gamma register values as the reference Gamma register values when a maximum deviation between the set of optimal Gamma register values and the corrected Gamma register values is smaller than a value; and using the initial Gamma register values as the reference Gamma register values when the maximum deviation between the optimal Gamma register values and the corrected Gamma register is greater than the value.

In some embodiments, the step of selecting, from the x sets of alternate Gamma register values, a set that is closest to the corrected Gamma values as a set of optimal Gamma register values, includes:

Obtaining a set of original optimal Gamma register values based on the corrected Gamma register values corresponding to the s binding points; and Selecting a set of alternate Gamma register values that is most frequently designated as the set of original optimal Gamma register values to be the set of optimal Gamma register values.

In some embodiments, the step of selecting, from x sets of alternate Gamma register values, wherein each set corresponds to m binding points and the initial Gamma register values, a set of Gamma register values used for Gamma correction of the display module(s) as the reference Gamma register values further include:

selecting, from the x sets of alternate Gamma register values, a set which has biggest deviation from the corrected Gamma register values as a worst Gamma register values; and replacing the worst Gamma register values with the target Gamma register values and storing the target Gamma register values.

In some embodiments, the steps of selecting, from the x sets of alternate Gamma register values, a set which has biggest deviation from the corrected Gamma register values as a worst Gamma register values; further includes obtaining a set of original worst Gamma register values based on the corrected Gamma register values corresponding to the s binding points; and selecting a set of alternate Gamma register values that is most frequently designated as the set of original worst Gamma register values to be the set of worst Gamma register values.

In some embodiments, the s binding points are selected from the first successive s binding points in the set of m binding points.

In some embodiments, the m binding points are divided into multiple groups, each corresponding to a different backlight brightness In some embodiments, the initial Gamma register values are fixed values.

In some embodiments, the target Gamma register values are used as the initial Gamma register values for the Gamma correction of the next display module.

In a second aspect, there is provided a display module Gamma correction device, including:

a storage unit configured to store m binding point values of a grayscale corresponding to a set of initial Gamma register values and x sets of alternate Gamma register values;

a Gamma correction unit configured to obtain corrected Gamma register values corresponding to binding points of a grayscale by correcting register values of s binding points selected from the set of m binding points of the grayscale based on a group of initial Gamma register values that correspond to the m binding points and a Gamma curve; and a reference Gamma register value selecting unit configured to select, from x sets of alternate Gamma register values wherein each set corresponds to m binding points and the initial Gamma register values, a set of Gamma register values used for Gamma correction of the display module(s) as reference register values.

The Gamma correction unit is further configured to perform Gamma correction on the remaining (m−s) binding points based on the reference Gamma register values and the target Gamma curve so as to obtain a set of target Gamma register values corresponding to the m binding points; and wherein s, m, and x are all integers greater than one.

In some embodiments, the Gamma correction unit is further configured to perform the steps of selecting, from the x sets of alternate Gamma register values, a set that is closest to the corrected Gamma register values as a set of optimal Gamma register values; using the set of optimal Gamma register values as reference Gamma register values when a maximum deviation between the set of optimal Gamma register values and the corrected Gamma register values is smaller than a value; and using the initial Gamma register values as the reference Gamma register values when the maximum deviation between the optimal Gamma register values and the corrected Gamma register is greater than the value.

In some embodiments, the reference Gamma register value selecting unit is further configured to perform the steps of obtaining a set of original optimal Gamma register values based on the corrected Gamma register values corresponding to the s binding points; selecting a set of alternate Gamma register values that is most frequently designated as the set of original optimal Gamma register values to be the set of optimal Gamma register values; selecting from the x sets of Gamma register values the set that deviates most from the Gamma register values being corrected to be the worst Gamma register values; replacing the worst Gamma register values with a set of target Gamma register values obtained after performing Gamma correction.

In some embodiments, the steps of selecting the optimal Gamma register values and the worst Gamma register values further includes:

obtaining a set of original worst Gamma register values based on the correct Gamma register values corresponding to the binding points; and selecting a set of alternate Gamma register values that is most frequently designated as the original worst Gamma register values.

In some embodiments, the s binding points are selected from the first successive s binding points in the set of m binding points.

In some embodiments, the m binding points are further divided into multiple groups, each corresponding to a different backlight brightness.

In some embodiments, initial Gamma register values are fixed values.

In some embodiments, the target Gamma register values are used as the initial Gamma register values in Gamma-correction of the next display module.

In a third aspect, there is provided a computer-readable storage medium, wherein the computer readable storage medium stores instructions for causing Gamma correction of the display module when the instructions are run in a Gamma correction device configured to performs a Gamma correction method according to the first aspect described above.

In a fourth aspect, there is provided a computer program product that includes instructions for causing a display module Gamma correction device to perform the method as described in the first aspect, when the computer program product is run in a Gamma correction device configured to perform methods according to the first aspect.

Methods and devices for correcting Gamma parameters in display module(s) as provided by embodiments of the present disclosure achieves correction of Gamma parameters corresponding to the binding point by selecting more optimal Gamma register values as the reference Gamma register values.

Embodiments of the present disclosure add a process of selecting reference Gamma register values which has the benefit of reducing overall cycle time of the Gamma correction process.

Once a Gamma register value is inputted, the entire Gamma correction process involves display driver, optical sampling, processing, transmission, and feedback.

Thus, conventional Gamma correction necessarily involves the combination of the display unit and the optical sampling unit to accomplish.

In contrast, methods disclosed herein utilize more optimal reference Gamma register values selected via comparative procedures which in turn will only require the Gamma-correction unit to accomplish.

The use of more optimal Gamma register values will reduce correction cycles. That is, when reference Gamma register values is the alternate Gamma register value, it will greatly improve the Gamma correction time of embodiments disclosed herein.

Methods in accordance with embodiments of the present disclosure can improve the Gamma-correction time requirement in mass production of displays due to non-uniformity of products.

BRIEF DESCRIPTION OF THE DRAWINGS

To more clearly illustrate some of the embodiments, the following is a brief description of the drawings.

The drawings in the following descriptions are only illustrative of some embodiments. For those of ordinary skill in the art, other drawings of other embodiments can become apparent based on these drawings.

DETAILED DESCRIPTION

Figure 1:
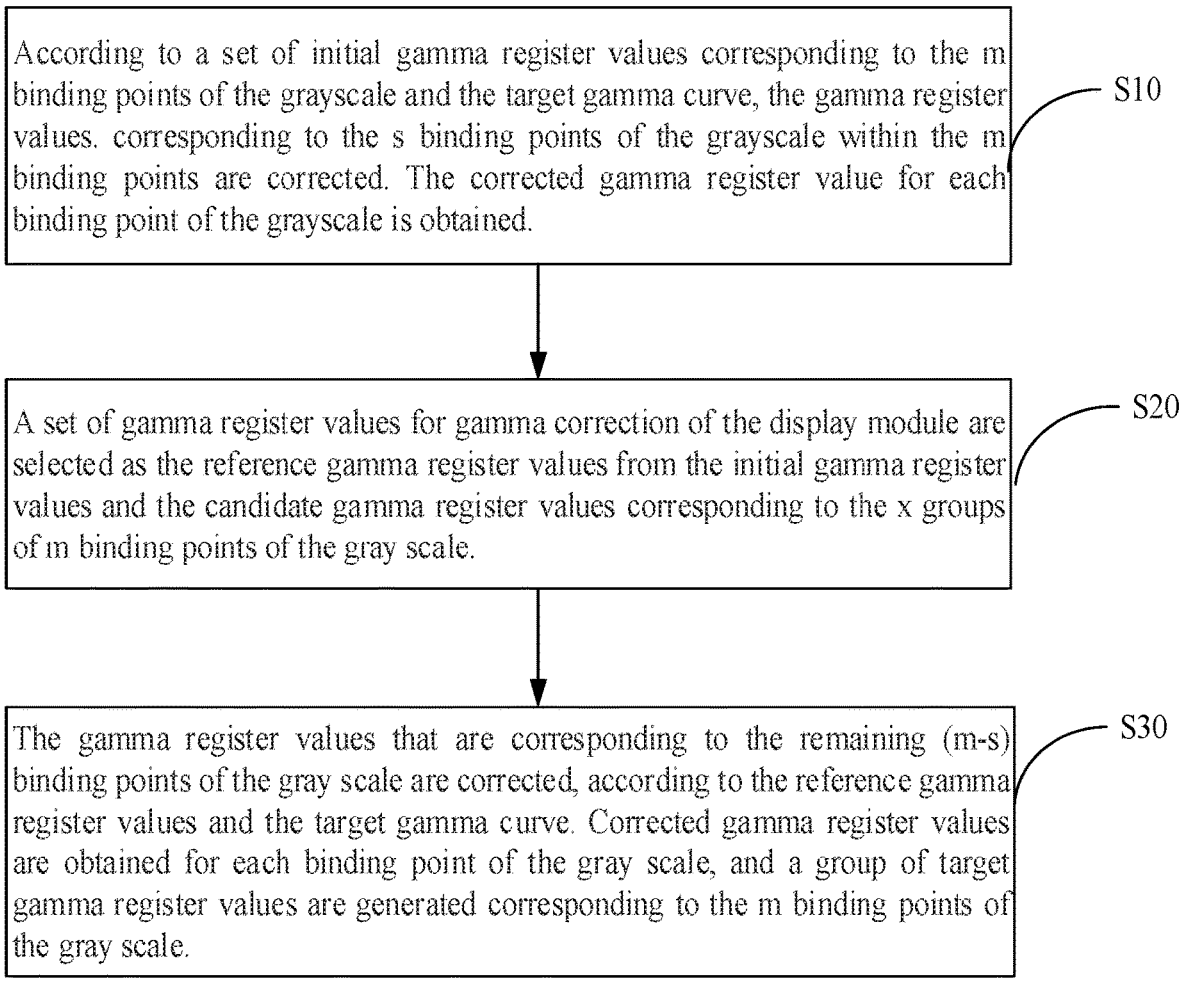
FIG. 1 is a flowchart of a Gamma correction method in accordance with embodiments of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. can be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or other structure is referred to as being "on" or extending "onto" another element, it can be directly on or extend directly onto the other element or intervening elements can also be present. In contrast, when an element is referred to as being "directly on" or extending "directly onto" another element, there are no intervening elements present.

Likewise, it will be understood that when an element such as a layer, region, or substrate is referred to as being "over" or extending "over" another element, it can be directly over or extend directly over the other element or intervening elements can also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

Relative terms such as "below" or "above" or "upper" or "lower" or "horizontal" or "vertical" can be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The inventors of the present disclosure have recognized that, because AMOLED displays are driven by electric currents, the driving actions of the thin-film transistors (TFTs) happen at the linear region of the I-V curve, and the operating voltage range is narrow, which causes the AMOLED to be very sensitive to changes in the data voltage. The difference of even a few millivolts is also reflected. In order to ensure the quality and performance of the displays, Gamma correction is required for each display module.

At present, when Gamma correction is performed on an AMOLED product, the initial adjustment value stored in the register corresponding to the red green, blue, and pixel driving voltage is preset. When a display module undergoes Gamma correction, Gamma correction is done by moving the initial value to the target value.

Therefore, the closer the initial value is to the target value, the shorter the time it takes for the Gamma correction, and vice versa. In prior art methods, after completing the Gamma correction of the display module, the initial value is restored to the preset initial adjustment value, the system moves onto correction of the next module, and another round of Gamma correction starts. There are also some methods that uses the product register value of the last Gamma correction as the initial value for the next adjustment cycle.

However, due to process errors inherent in the product production process, the uniformity of products will inevitably have a certain degree of deviation. Therefore, the initial values required by each product are not the same. Thus, fixed initial values are not satisfactory in actual production situations. Failure to select the appropriate initial value will result in more cycles of Gamma correction related steps which will increase the Gamma correction time and affect production efficiency.

AMOLED products can employ automated Gamma correction during mass production. A Gamma correction device can include a display driving unit, an optical measuring unit, and a Gamma correction unit, for example.

The display driving unit is configured to provide a driving signal for driving the display module, for example, an ARM (Advanced RISC Machine) processor or an FPGA (Field-Programmable Gate Array)+PC (personal computer) Computer) and so on.

The optical measuring unit (commonly referred to as optical test system) is used to measure the display brightness of the display module and to provide feedback of optical parameters of the display module. The Gamma correction unit is configured to perform real-time red, green and blue three-color sub-pixel voltage matching according to the driving voltage and brightness mapping relationship of the display module to correct the optical parameters of the product and obtain the corrected Gamma register values.

The various device components, blocks, or portions may have modular configurations, or are composed of discrete components, but nonetheless may be referred to as "modules" in general. In other words, the "modules" referred to herein may or may not be in modular forms.

In Gamma correction processes, the initial values stored in the Gamma registers corresponding to the driving voltages of the red, green and blue three-color sub-pixels will be preset. In one approach: the reference adjustment value is a fixed value.

In this approach, when a display module starts Gamma correction, the correction process proceeds by adjusting the reference value to the target value, after which, the reference value is restored to the initial fixed preset value before commencing Gamma correction on the next display module. In another approach: the reference adjustment value is a variable value in which the Gamma register value after the last round of Gamma correction is used as the reference adjustment value of the next round of Gamma correction.

In this approach, when a display module starts Gamma correction, the adjustment process proceeds by adjusting the reference value to the target value. After completing a round of Gamma correction, the corrected value is then used as the reference value for the next round of correction, and cycle of Gamma correction is continued.

Due to inherent process errors in production processes, the uniformity of the display products will inevitably have a certain degree of deviation, so the initial values required by the product are not the same. The larger the process deviation, the longer the adjustment path from the initial adjustment value to the target value will be, and the more the number of Gamma correction cycles will be.

In some embodiments, Gamma correction methods provided by the present disclosure may be applied to an AMOLED display screen or a display screen that needs to perform Gamma correction. The purpose of Gamma correction is to adjust the brightness and chromaticity of the display module to a target value. Usually, the brightness is adjusted according to the curve of Gamma value 2.2, and the chromaticity is adjusted according to the customer's needs.

Generally, the register values corresponding to the grayscale levels of the red, green and blue sub-pixels are adjusted so that the optical parameters such as the brightness and color coordinates of the display module are adjusted to the corresponding target values. Methods for Gamma correction for each sub-pixel of the display module to be corrected (for example, red, green and blue three-color sub-pixels) are exactly the same. To avoid redundancy, only the specific process of the Gamma correction method is emphasized here.

Accordingly, FIG. 1 shows an exemplary embodiment of a display module Gamma correction method.

S10. In a set of m binding points of a grayscale that correspond to a set of initial Gamma register values and target Gamma curve, apply Gamma correction to s binding points within the m binding points to obtain corrected Gamma register values for each binding points of the grayscale.

In doing so, the data structure for the Gamma register values can be a two-dimension array structure or other predetermined data structure type. For example, as shown in Table 1, a set of Gamma register values is stored in an array structure where the length of the array is greater than or equal to the total number of grayscale binding points, m. These m registers are used to store the Gamma register values of the Gamma-corrected m grayscale binding point. Gamma correction for the red, green and blue sub-pixels are implemented in the same way.

TABLE 1

An array structure with a width of 1

| | |
|---|---|
| A[0] | 0 |
| A[1] | 1 |
| | . . . |
| A[m − 2] | m − 2 |
| A[m − 1] | m − 1 |

Extending from Table 1, the array structure may be expanded to a width of n, where the number n represents the maximum number of samples. In exemplary embodiments, n>x+1, and the extended data structure is used to store different sample Gamma register data, as shown in Table 2.

TABLE 2

An array structure of width n

| | 0 | 1 | . . . | n-2 | n-1 |
|---|---|---|---|---|---|
| A [0] | 0 | 0 | | 0 | 0 |
| A [1] | 1 | 1 | | 1 | 1 |
| | . . . | . . . | . . . | . . . | . . . |
| A [m-2] | m-2 | m-2 | | m-2 | m-2 |
| A [m-1] | m-1 | m-1 | | m-1 | m-1 |

Because the process of Gamma correction is the same for red, green and blue sub-pixels, therefore, the data storage format is also the same. As shown in Table 3, the data structure includes the initial Gamma register values and the alternative Gamma register values corresponding to the red sub-pixel R; the initial Gamma register values and the alternate Gamma register values corresponding to the green sub-pixel G; and the initial Gamma register values and the alternate Gamma register values corresponding to the blue sub-pixel B.

The data used in the correction process are taken from the data structure space of Table 3. The data in the reference array structures of m, x, n are matched with the display driving unit and the optical measuring unit to perform the step-by-step gray level correction (correction proceeds in sequential order starting from array position [0]).

TABLE 3

Array structure of width n corresponding to red, green and blue sub-pixels

| | 0 | 1 | . . . | n-2 | n-1 |
|---|---|---|---|---|---|
| R [0] | 0 | 0 | | 0 | 0 |
| R [1] | 1 | 1 | | 1 | 1 |
| | . . . | . . . | . . . | . . . | . . . |
| R [m-2] | m-2 | m-2 | | m-2 | m-2 |
| R [m-1] | m-1 | m-1 | | m-1 | m-1 |
| G [0] | 0 | 0 | | 0 | 0 |
| G [1] | 1 | 1 | | 1 | 1 |
| | . . . | . . . | . . . | . . . | . . . |
| G [m-2] | m-2 | m-2 | | m-2 | m-2 |
| G [m-1] | m-1 | m-1 | | m-1 | m-1 |
| B [0] | 0 | 0 | | 0 | 0 |
| B [1] | 1 | 1 | | 1 | 1 |
| | . . . | . . . | . . . | . . . | . . . |
| B [m-2] | m-2 | m-2 | | m-2 | m-2 |
| B [m-1] | m-1 | m-1 | | m-1 | m-1 |

In Gamma correction processes of the present disclosure, a small portion of the grayscale levels is selected as the grayscale binding points or adjustment points, and the Gamma curve is fitted according to these adjustment points. For example, in an 8-bit color depth system, the grayscale levels are L0-L255. If L255, L223, L191, L128, L107, L64, L35, L15, and L0 were to be selected as adjustment points, these adjustment points would be called the binding points of this grayscale.

The order of the binding points is not particularly limited. For example, the first binding point of the m binding points may correspond to the lowest gray level L0, and the second binding point may correspond to the highest gray level L255, the 3rd to the 9th binding points may correspond to L15, L35, L64, L107, L128, L191, L223.

In embodiments of the present disclosure, the manner of selecting the m binding points are not particularly limited. It would be within the skill of the art to refer to related technologies in making such choices.

Considering that the display module, after being incorporated into a display device, will be used to display under different backlight brightness, Gamma correction will be performed to account for different backlight brightness. Accordingly, in some embodiments, the m binding points are divided into multiple groups, each corresponding to a different backlight brightness.

As an example, a total of 40 binding points are selected. The $1^{st}$ to $10^{th}$ binding points correspond to a first backlight brightness, said binding points are selected from the range of L0-L255. The $11^{th}$ to $20^{th}$ binding points correspond to a second backlight brightness, said binding points also selected from the range of L0-L255.

The $31^{st}$ to $40^{th}$ binding points correspond to a third backlight brightness, said binding points also selected from the range of L0-L255. The bind points may be in sequence (e.g. the first 10 levels in a grayscale) or may be out of sequence (e.g. the $1^{st}$, $5^{th}$, $9^{th}$, $13^{th}$ . . . $37^{th}$ level in a grayscale), depending on the situation.

The initial Gamma register values are a set of predetermined values. Illustratively, the initial Gamma register values may be fixed values, i.e. the initial values used to correct the Gamma register values of each display module are fixed; alternatively, the initial Gamma register values may be variables, i.e. the current initial Gamma register values may be the values of the corrected Gamma register values from the previous display module.

The target Gamma curve is the Gamma curve that the display module wants to have after Gamma correction. The process of Gamma correction may include, for example, first calculating target values for the optical parameter (brightness, color coordinate, etc.) based on the target Gamma curve, then, on the display module, adjusting the register values corresponding to the binding points, followed by measuring the optical parameters of the display module with the adjusted register values, and repeat the process until the values of all binding points are adjusted to the target values (determined by the product's specification at design time), and finally obtaining the set of adjusted register values for the Gamma registers.

Here, when applying Gamma-correction to the s binding points in the set of m binding points, the method for selecting the s binding points out of the set of m binding points is not particularly limited.

For example, the s binding points may be selected from consecutive gray levels or non-consecutive gray levels. The order of adjusting the gray levels of the binding points may be predetermined, and the gray levels of the first s binding points may be corrected in a predetermined order where the first s binding points are prioritized over the later s binding points, but the s binding points do not necessarily have to be the first s binding points in the set of m binding points.

The above s, m, and x are all integers greater than 1, m may be, for example, 72, x may be, for example, 6, and s is necessarily less than m.

S20. Select from the initial set of Gamma register values and the x groups of m binding points a set of Gamma register values that are used for Gamma correction to be the set of reference Gamma register values.

That is, either the initial Gamma register value is selected as the reference Gamma register values used to correct the remaining binding points; or a set of Gamma register values is selected from the x group of alternative Gamma register values as the reference Gamma register value to correct the remaining binding points.

In the above, the m binding points of the x group refers to the fact that embodiments of the present disclosure provide x groups of m binding points, each x group corresponds to an alternate set of Gamma register values.

The x-group alternate Gamma register value can be a fixed value or a variable value. For example, each time a round of Gamma correction is completed, the target Gamma register value after Gamma correction may replace one of the x-group alternative Gamma register values. Accordingly, the initial Gamma register values used for each Gamma correction cycle and the x groups of alternate Gamma register values are not necessarily the same.

It will be understood by those skilled in the art that in the case where the x sets of alternative Gamma register values are fixed values, the initial set of x groups of alternate Gamma register values must be different, otherwise there is no need to input the x groups.

In the case where the x groups of alternative Gamma register values are variable values, the initial set of x groups of alternate Gamma register values may be the same.

Figure 2:
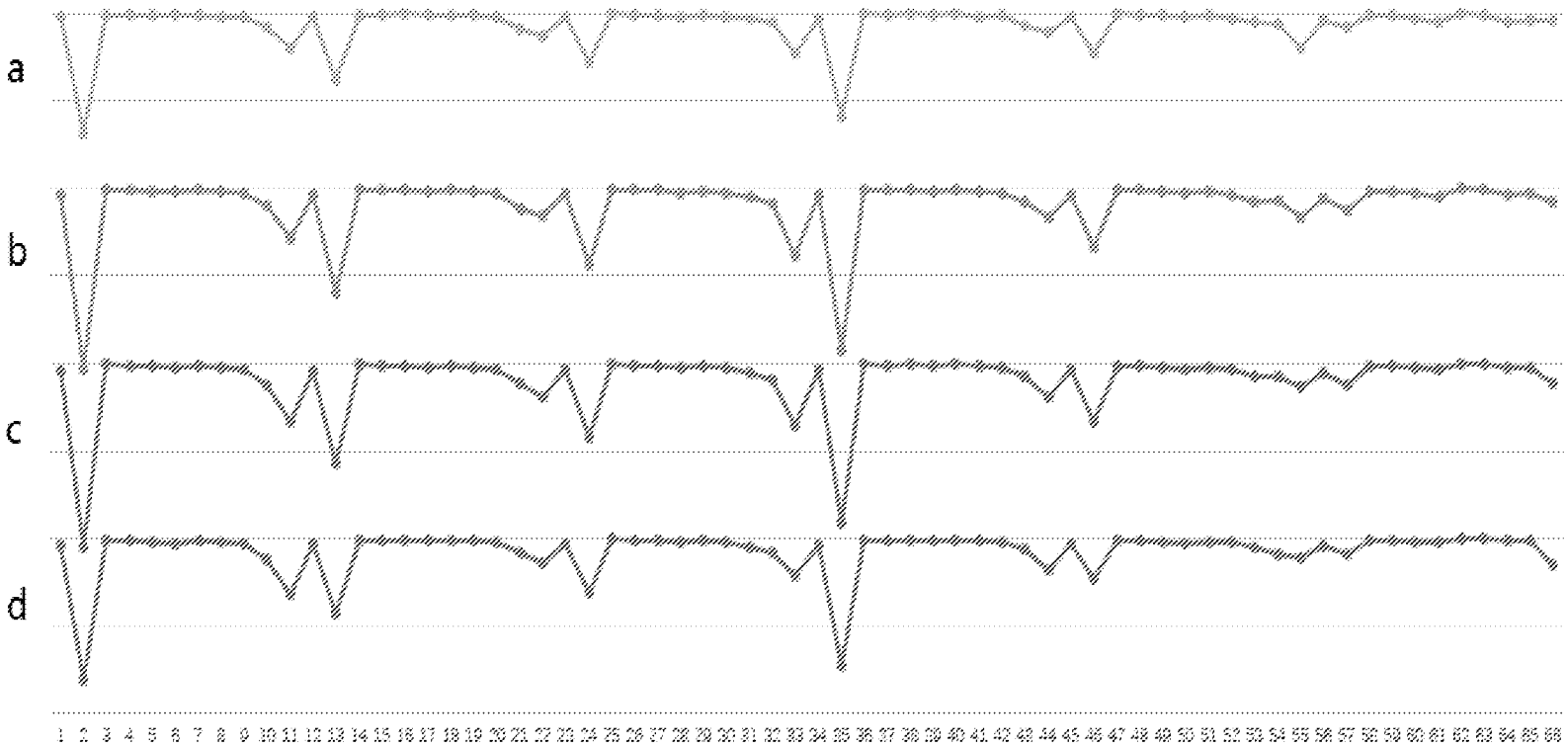
FIG. 2 is a schematic diagram of an alternative Gamma register value in accordance with another embodiment of the disclosure.

As shown in FIG. 2, a schematic diagram of data distribution of four groups (panel a, panel b, panel c, and panel d) of alternate Gamma register values is shown. The horizontal axis with values ranging from 1 through 66 represents sets of grayscale binding points, and the vertical axis represents Gamma register values for each set of grayscale binding points.

For example, the data used in the actual Gamma correction and correlation calculations can be derived from the Gamma data structure space m*n of Table 1 and Table 2. For example: as shown in FIG. 2, the vertical axis can be seen as deviation or offset rates of the different sample Gamma registers in n samples. The horizontal axis represents the number of m Gamma corrected grayscale levels.

In actual large batch productions, the Gamma register data distribution can be regarded as similar to the distribution illustrated in FIG. 2, where the horizontal axis represents different grayscale adjustable nodes, related to designs; and the vertical axis represents deviation between different samples, related to uniformity among the products.

By comparing the vertical axes, the amount of offsets of different sample Gamma registers can be obtained.

As a result of product uniformity (or lack of), when the target Gamma register value is significantly different from the initial adjustment value of the register (n sample values in the array), for example, as illustrated in panel b and panel d in FIG. 2), the program performing the path of the gamma correction will have a large number of tests and adjustments. Various embodiments disclosed herein provide a program flow and its real-time comparison method to find the most matching sample values more efficiently.

For example, the Gamma the correction binding points grayscale levels can be a total of 72, where the array 0-71 represents the different gray levels of all Gamma vales. The data space sample width can be 6, that is, 6 samples are stored, as described in more detail below.

Figure 3:
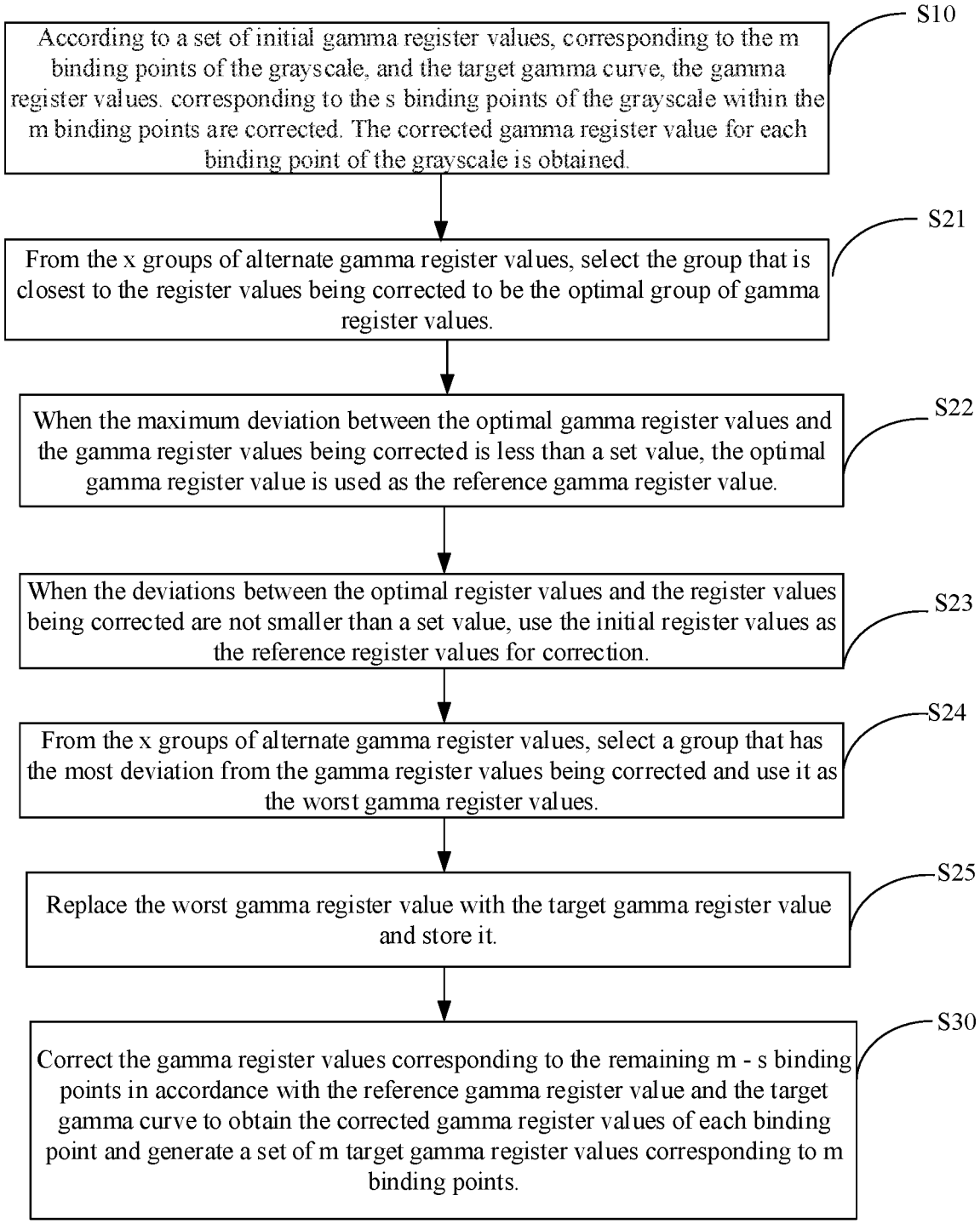
FIG. 3 is a flowchart of a Gamma correction method provided by an embodiment of the present disclosure.

In some embodiments, as shown in FIG. 3, S20 includes:

S21. From the x groups of alternate Gamma register values, select the group that is closest to the register values being corrected to be the optimal group of Gamma register values.

After adjusting the values of the m binding points, a set of Gamma-corrected m binding points will be obtained. From the x groups of Gamma register values, select one group that is closest to the m register values being corrected and use this group as the optimal reference Gamma register values.

Once the optimal Gamma register value is selected, perform a comparison between the optimal register values and the register values being corrected, and then, based on the outcome of the comparison, perform either step S22 or S23. Finally determine whether to use the initial Gamma register values as the reference Gamma register values or to use the optimal Gamma register values as the reference Gamma register values.

S22. When the maximum deviation between the optimal Gamma register values and the Gamma register values being corrected is less than a set value, the optimal Gamma register value is used as the reference Gamma register value.

Here, compare the values of registers being corrected that correspond to each of the s binding points the register values of the optimal register values to obtain s number of deviation values. When the largest deviation value in the s number of deviations is less than a set number, use the optimal register values as the reference register values for correction.

S23. When the deviations between the optimal register values and the register values being corrected are greater than a set value, use the initial register values as the reference register values for correction.

Here, use initial register values as the reference register values for correction when the largest deviation among the s number of deviation values is greater than or equal to a set value.

The size of the set value may be determined according to actual conditions, and may be a fixed value or a variable value. Illustratively, the set value may be, for example, the maximum deviation between the initial Gamma register value and the register value being corrected.

By comparing the maximum deviation between the initial Gamma register values and the Gamma register values being corrected, and the maximum deviation between the alternate register values and the Gamma register values being corrected, the set of values that have smaller deviation may be selected as the reference register values, which then can shorten the distance between the reference register values and the target register values, thereby, reducing the time for Gamma correction.

In some embodiments, S20 also includes:

S24. From the x groups of alternate Gamma register values, select a group that has the most deviation from the Gamma register values being corrected and use it as the worst Gamma register values.

Among the set of worst Gamma register values, the deviation between the Gamma register value corresponding to the s binding point and the Gamma register value being corrected is the largest.

S25. Replace the worst Gamma register value with the target Gamma register value and store it.

Here, the target Gamma register value is the target Gamma register value obtained from the previous round of Gamma correction.

In the above, the labels S21-S25 are only the labels for the steps, and do not represent the order in which they are performed.

In this way, by using the target Gamma register values obtained in the previous cycle of Gamma correction to replace the worst Gamma register values in the x set of alternate Gamma register values, the x-group alternative Gamma register values can be made to be closer and closer to the production errors inherent due to the production process.

Thus, reference Gamma register values taken from the x set of alternate Gamma register values will be closer to the target values, which in turn shortens the time require for Gamma correction.

Regarding step S21 and step S24, in some embodiments, the steps of selecting from among the x groups of alternate Gamma register values, the set of alternate Gamma register values closest to the Gamma register values being corrected to be the optimal Gamma register value, and the set of alternate Gamma register values that deviate the most from the Gamma register value to be the worst Gamma register value, includes:

S01. Acquire an optimal Gamma register value and a worst Gamma register value respectively matched with Gamma register values being corrected that corresponds to s binding points.

At this time, the optimal Gamma register value and the worst Gamma register value corresponding to each binding point may not necessarily be identical.

This step may be performed once each correction cycle for each of the s binding points, or after the correction of all the s binding points is completed, to systematically find the optimal and worst Gamma register value corresponding to the s binding point, respectively.

In the above, the set of x register values may be completely sorted (from 1 to x), or, alternatively, only identifying from among the x set of register values the set of values that are closet and farthest without sorting the register values.

S02. Select a set of alternate Gamma register values that are the most optimal Gamma register value as the final optimal Gamma register value, and select a set of alternate Gamma register values that are the most frequent Gamma register value as the final worst Gamma register value.

After correcting the s binding points, proceed to perform step S02. When two sets of alternative Gamma register values have the same frequency as the optimal Gamma register value and the worst Gamma register value, either set may be selected as the final set of worst/optimal register values.

S30, correct the Gamma register values corresponding to the remaining m−s binding points in accordance with the reference Gamma register value and the target Gamma curve to obtain the corrected Gamma register values of each binding point and generate a set of m target Gamma register values corresponding to m binding points.

Here, the reference Gamma register value is closest to the target Gamma register value, and the Gamma register value corresponding to the remaining m−s binding points in the set of m binding points is corrected according to the reference Gamma register value.

The correction methods are the same as for the s binding points except that the reference register values may be different. Assemble the set of m corrected Gamma register values to form a set of target Gamma register values, and then store said target Gamma register values.

Methods for correcting display module exemplified by embodiment of the present disclosure correct display module Gamma register values through selecting more optimal Gamma register values as the reference Gamma register values to complete the correction of the binding points.

Compared with conventional methods, embodiments of the present disclosure add a process of selecting reference Gamma register values which has the benefit of reducing overall cycle time of the Gamma correction process. Once a Gamma register value is inputted, the entire Gamma correction process involves display driver, optical sampling, processing, transmission, and feedback.

Thus, conventional Gamma correction necessarily involves the combination of the display unit and the optical sampling unit to accomplish. In contrast, methods disclosed herein utilize more optimal reference Gamma register values selected via comparative procedures which in turn will only require the Gamma-correction unit to accomplish.

The use of more optimal Gamma register values will reduce correction cycles. That is, when reference Gamma register values is the alternate Gamma register value, it will greatly improve the Gamma correction time of embodiments disclosed herein. Methods in accordance with embodiments of the present disclosure can improve the Gamma-correction time requirement in mass production of displays due to non-uniformity of products.

Embodiments of the present disclosure further provide a Gamma correction device for a display module, including:

a storage unit configured to store a set of m initial Gamma register values and x sets of alternate Gamma register values each set corresponding to m binding point;

a Gamma correction unit configured to perform Gamma correction on s Gamma register values corresponding to s binding points based on a set of m initial Gamma register values corresponding to m binding points of a grayscale and a target Gamma curve to obtain Gamma-corrected register values for all binding points of the grayscale.

In some embodiments, the s binding points are the first s binding points in the set of m binding points in consecutive sequence.

In some embodiments, the m binding points comprises multiple groups, each corresponds to a different backlight brightness.

In some embodiments, the initial Gamma register values are fixed values.

In some embodiments, the target Gamma register value is used as the initial Gamma register value for Gamma correction in the next display module.

A reference Gamma register value selecting unit configured to select a group of Gamma register values as reference Gamma register values for performing Gamma-correction in a display module, wherein said reference Gamma register values are selected from initial Gamma register values and alternative Gamma register values corresponding to the x sets of m binding points.

In some embodiments, the process performed by the reference Gamma register value selection unit, includes:

selecting from among the x sets of alternate Gamma register values, the set which is closest to the Gamma register values being corrected as the optimal Gamma register values.

using the optimal Gamma register values as the reference Gamma register values when the maximum deviation of the optimal Gamma register values from the Gamma register values being corrected are less than a predetermined value;

using the initial Gamma register values as the reference Gamma register values when the maximum deviation of the optimal Gamma register values from the Gamma register values being corrected are not less than a predetermined value.

In some embodiments, the processes performed by the Gamma register value selection unit, further includes:

selecting from the x sets of alternate Gamma register values the set which deviates most from the Gamma register values being corrected as the worst Gamma register values;

replacing the worst Gamma register values with a set of target Gamma register values corresponding to the corrected Gamma register values in a display module after Gamma correction.

In some embodiments, the process of selecting an optimal Gamma register value and a worst Gamma register value performed by the reference Gamma register value selection unit includes:

obtaining optimal Gamma register values and worst Gamma register values corresponding to the first s Gamma register values to be corrected;

selecting the set of alternate Gamma register values that are the most frequently chosen as the optimal Gamma register values to be the final optimal Gamma register values, and selecting the set of alternate Gamma register values that are most frequently chosen as the worst Gamma register values to be the final worst Gamma register values.

A Gamma correction unit is further configured to correct the Gamma register values corresponding to the remaining m−s binding points according to the reference Gamma register values and the target Gamma curve, thereby, obtaining corrected Gamma register values for each binding point so as to form m binding points corresponding to a set of target Gamma register values.

The Gamma correction device disclosed herein have at least the same advantages as the Gamma correction methods disclosed herein and shall not be repeated here again.

Figure 4:
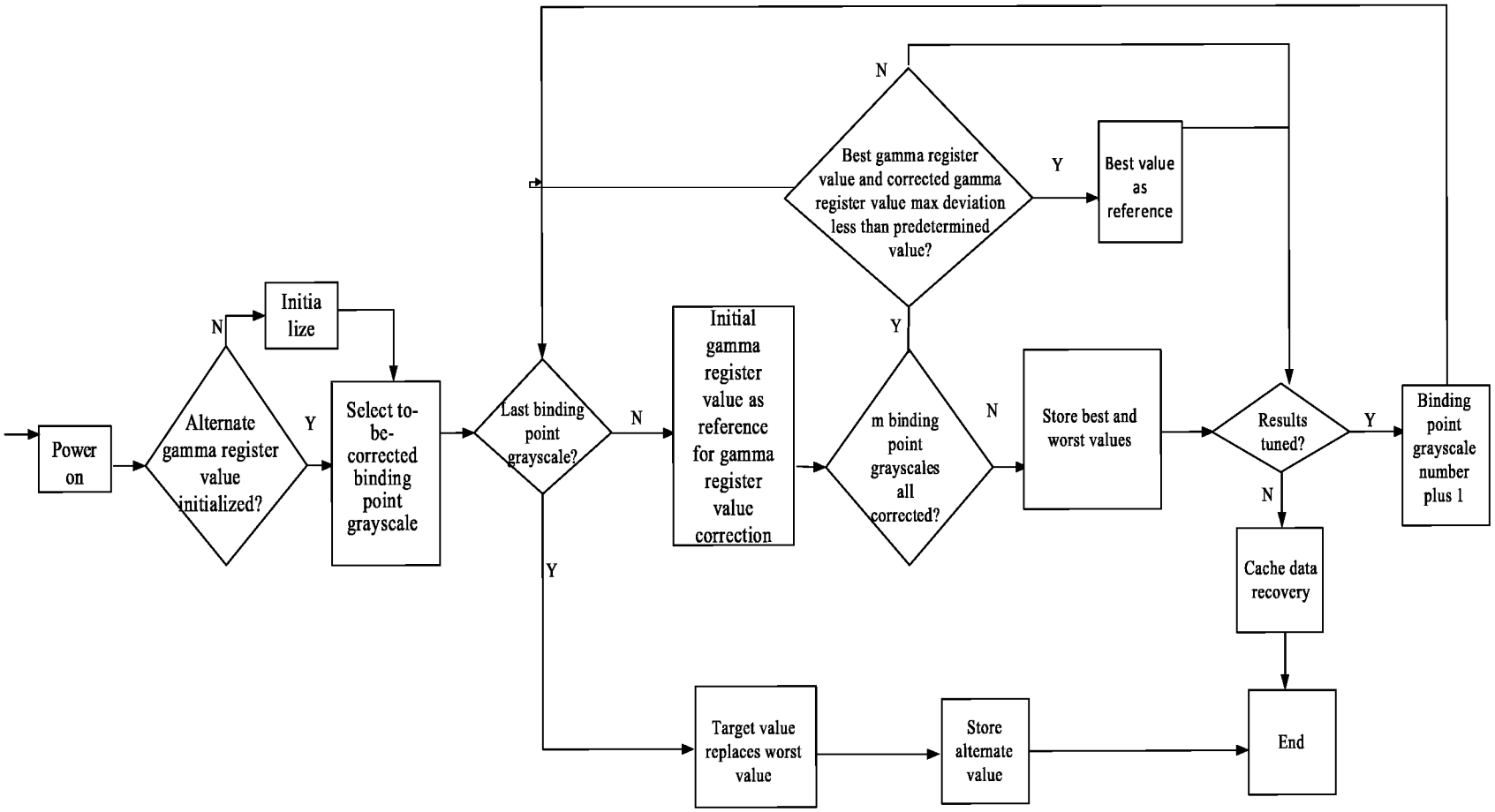
FIG. 4 is a flowchart of the Gamma correction process for display modules in accordance with embodiments of the present disclosure.

Illustratively, with reference to FIG. 4, the working process of the Gamma correction device exemplified by embodiment of the present disclosure is described:

When the first display module is initially Gamma-corrected, the power is turned on, the Gamma correction device is placed into operation mode, and the display module is turned on. Each time the power is turned on, all Gamma register values in the x group of optional Gamma register value needs to be reset.

However, once the power is turned on the Gamma register values in the x group of optimal Gamma registers do not need to be reset in Gamma-correction of subsequent display modules. In such subsequent Gamma-corrections, values of alternate Gamma registers are continuously updated.

Beginning with reference to the initial Gamma register value, the m binding points selected according to a predetermined rule are sequentially corrected, and the optimal Gamma register value and the worst Gamma register value corresponding to each binding point are selected.

When the debugging result is appropriate, repeat the above steps according to the next binding point selected according to a predetermined rule. If the debugging result is not suitable, the data buffered before the binding point is restored, the loop is ended, and the Gamma-correction on the binding points is restarted.

After the m binding points are corrected, reference Gamma register values are re-selected, and the remaining m−s binding points are Gamma-corrected. After all the s binding points are corrected, the worst Gamma register values are replaced with the obtained target Gamma register values and stored, and the correction of the display module is ended.

Figure 5:
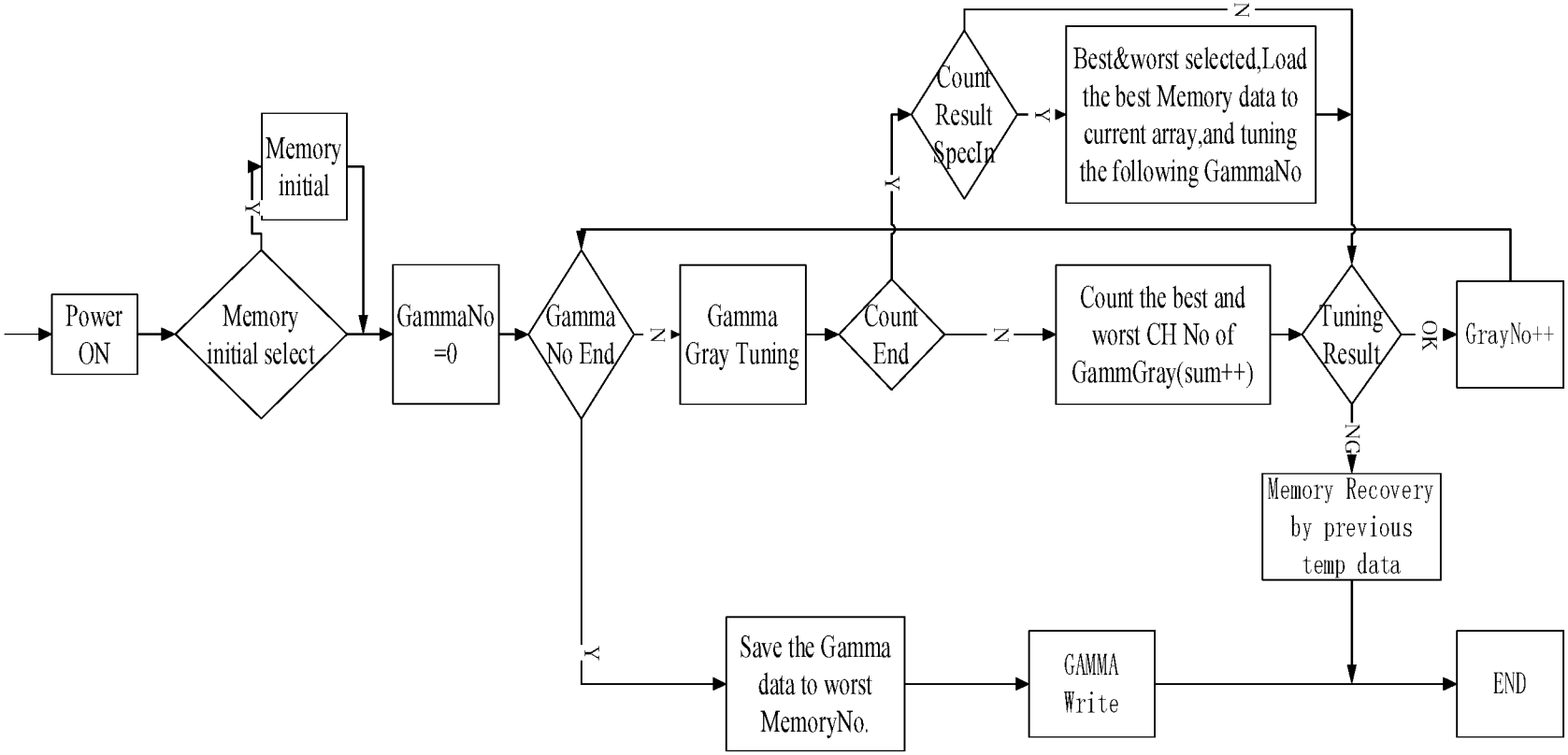
FIG. 5 is a flowchart of the Gamma correction process for display modules in accordance with some other embodiments of the present disclosure.

FIG. 5 is a flowchart of the Gamma correction process for display modules in accordance with some other embodiments of the present disclosure.

In the Gamma correction process, the program uses the initialization values in the R[0]&G[0]&B[0] arrays (referring back to Table 3) to perform step-by-step adjusting with a display driver unit and an optical measurement unit. The testing and adjusting are in the order of the arrays, starting from [0].

As illustrated in FIG. 5, in a first step, the Gamma grayscale adjustment order is set, for example based on the grayscale adjustment order in the array (0~(m−1)) of Table 3, corresponding to "GammaNo" in FIG. 5.

In a second step, add the previous i-level grayscale points (0–i of the array subscript) on the conventional Gamma correction process, corresponding to "Count End" in FIG. 5.

In a third step, after correcting the current gray level (0–i), based on comparing the adjusted array value with the sample value, find out and count the closest sample and the most deviating sample in the current gray level, corresponding to "Count the best and worst CH No of GammGray (sum++)" in FIG. 5.

In a fourth step, prior to the completion of the i-level grayscale, calculate the correct and complete deviation of the Gamma register value from the n-sample in the 0~(i−1) grayscale testing point, with sample numbers jmin, jmax.

The choice of i can be a continuous integer (0, 1, 2, . . . ), or it can be a specified number of any selected previous 0~(m−1) items.

In a fifth step, determine whether the total deviation of the corrected Gamma register from the closest sample conforms to the preset error value; if yes, the remaining (i~(m−1)) array value of the sample j (the space corresponding to jmin) can be taken as the initial value, specifically as the initial value of the remaining product Gamma grayscale correction; if not, the remaining Gamma grayscale correction initial values are not updated; corresponding to "Best&worst selected, Load the best Memory data to current array, and tuning the following GammaNo" in FIG. 5.

In a sixth step, "store the array value after the adjustment is completed into the space corresponding to jmax; corresponding to "Save the Gamma data to worst MemoryNo" in FIG. 5.

As such, to quickly find both the closest sample and the most deviating sample: for an array with a complete order (ordered array), a complete sorting of n sample data can be performed; for an array with incomplete order (non-complete sorting), the program finds only the closest sample (min) and the most deviating sample (max) among n samples.

Therefore, the following sequences can be employed according to embodiments of the present disclosure (1) Select the first i gray scales (0~(m−1)) in the Gamma gray scale levels, for example selecting continuously, or selecting at any intervals.

(2) Based on (1), the most matching data jmin among the n samples (the completed Gamma corrected data) is selected, based on the same grayscale determination of the first i Gamma grayscale data and the stored n samples.

(3) Based on (1) and (2), passing the closest matching Gamma data jmin of n samples as the initial value of the Gamma register of the gray level of the remaining current samples with unfinished Gamma correction, and performing Gamma correction with the initial value to be transmitted, thereby reducing the gamma correction path (reducing the testing and correcting time).

(4) Based on (1), (2), and (3), the size of the n sample spaces can be dynamically adjusted, and the n sample data are updated in real time, while the most deviating sample jmax data is overwritten by the newly generated sample data update.

(5) Query jmin and jmax preferential use of non-complete sorting method (also compatible with the use of complete sorting).

(6) Based on the above, as can be recognized by those of ordinary skilled in the art, the program flow logic can be readily modified with various variations, and the algorithm for finding jmin, jmax (as shown in FIG. 5) can still be implemented with the variations.

For the initial adjustment value of the Gamma register, the software is usually implemented based on a fixed preset value, that is, the software performs Gamma correction by adjusting from a fixed initial value to a target value; or the software uses the last target value as the initial adjustment value.

The program provides a programming algorithm based on the existing AutoGamma device and its matching comparison algorithm, and achieves the goal of reducing the gamma correction time in production by dynamically calculating the initial Gamma initial value that matches the current product in real time.

Embodiments of the present disclosure further provide a computer readable storage medium, wherein the computer readable storage medium stores instructions for causing the display module Gamma correction device to execute the above process when the instructions are run in said display module Gamma correction device.

Embodiments of the present disclosure further provide a computer program product comprising instructions, wherein when the computer program product is run in the display module Gamma correction device, the Gamma correction methods disclosed herein are performed.

Figure 6:
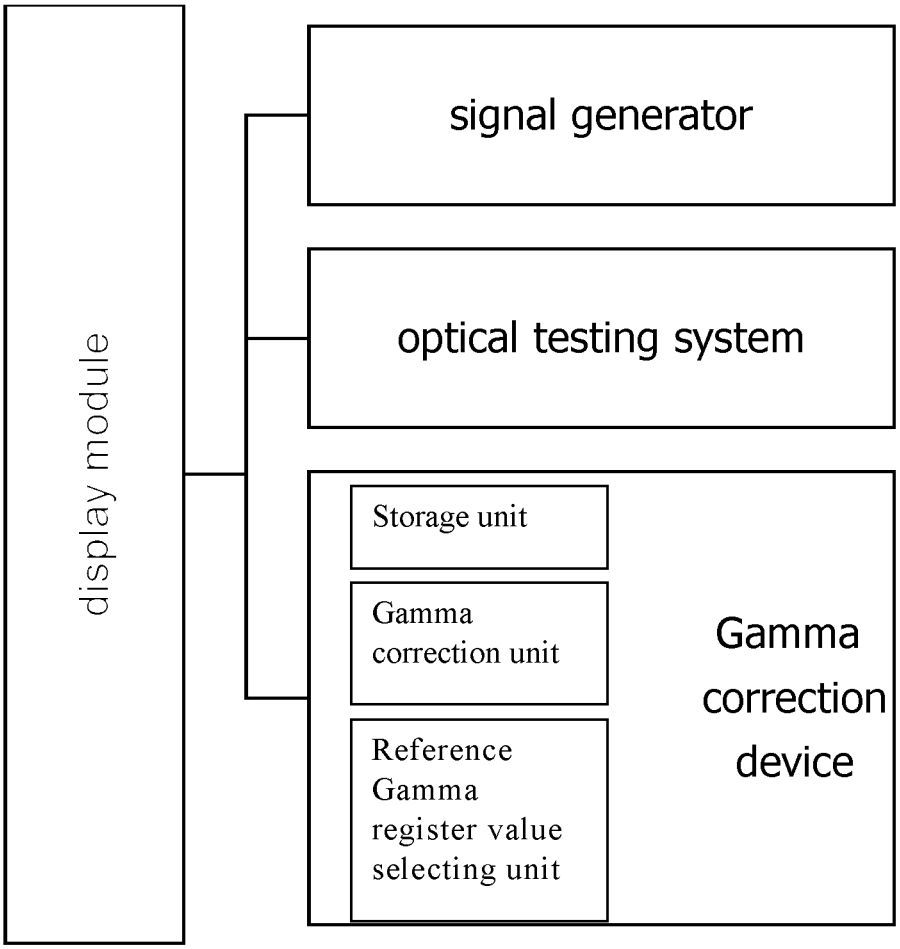
FIG. 6 is a block diagram illustrating a display module manufacturing system according to some embodiments of the present disclosure.

In another aspect, as illustrated in FIG. 6, a display module manufacturing system is provided. The system can be or part of, for example, an assembly line of display panels, where display modules can be conveyed consecutively over the signal generator, which can generate drive signals to drive the display module to display light or images for calibration.

The optical testing system can detect light or images from the display module, and feed the measured parameters to the Gamma correction device.

As described above, the Gamma correction device can include a storage unit configured to store m binding point values of a grayscale corresponding to a set of initial Gamma register values and x sets of alternate Gamma register values; a Gamma correction unit configured to obtain corrected Gamma register values for all binding points by correcting s binding points selected from the set of m binding points said correcting s binding points is based on a set of initial Gamma register points that correspond to the m binding points and a Gamma curve; and a reference Gamma register value selecting unit configured to select from the initial Gamma register values and the x sets of alternate Gamma register values corresponding to the m binding points a set of reference Gamma register values.

The Gamma correction device can perform Gamma corrections to the plurality of display modules on the assembly line according to the methods described above.

Embodiments of the present disclosure can have one or more advantages compared with conventional methods.

For example, for the initial adjustment value of the Gamma register, a conventional program is usually implemented based on a fixed preset value, that is, the program performs Gamma correction by adjusting from a fixed initial value to a target value; or the program uses the last target value as the initial adjustment value.

Embodiments disclosed herein provide a programming algorithm that can be implemented in an existing "AutoGamma" device, for example without modifying the hardware, yet with a matching comparison algorithm, and achieve the goal of reducing the Gamma correction time in production by dynamically calculating the initial Gamma initial value that matches the current product the best in real time.

It will be understood by those skilled in the art that all or part of the steps of implementing the above method embodiments may be completed by using hardware related to the program instructions. The foregoing program may be stored in a computer readable storage medium, and the program is executed when executed. The foregoing steps include the steps of the foregoing method embodiments. In some embodiments, the software, instructions or program product can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

The terms "first" and "second" are used for descriptive purposes only and are not to be construed as indicating or implying a relative importance or implicitly indicating the number of technical features indicated. Thus, elements referred to as "first" and "second" can include one or more of the features either explicitly or implicitly. In the description of the present disclosure, "a plurality" indicates two or more unless specifically defined otherwise.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

The computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment.

A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Implementations of the subject matter described in this specification are not limited to the AMOLED, and can be implemented with other types of displays, such as LCDs (liquid-crystal displays).

The displays can be have various applications, such as in a VR/AR device, a head-mount display (HMD) device, a head-up display (HUD) device, smart eyewear (e.g., glasses), an LCD TV, a light-emitting diode (LED) display TV, a smart home system, a flexible configuration, or any other monitor for displaying information to the user. In some embodiments, the display can have a touch screen.

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It is to be understood that "multiple" mentioned in the present disclosure refers to two or more than two. "And/or" describes an association relationship of associated objects and represent that three relationships can exist. For example, A and/or B can represent three conditions, i.e., independent existence of A, coexistence of A and B and independent existence of B. Character "I" usually represents that previous and next associated objects form an "or" relationship.

The above is only the preferred embodiment of the present disclosure and not intended to limit the present disclosure. Any modifications, equivalent replacements, improvements and the like made within the spirit and principle of the present disclosure shall fall within the scope of protection of the present disclosure.

The invention claimed is:

1. A method for Gamma correction in display module(s), the method comprising:

obtaining corrected Gamma register values corresponding to binding points of a grayscale by correcting register values of s binding points selected from a set of m binding points of the grayscale based on a group of initial Gamma register values that correspond to the m binding points and a target Gamma curve;

selecting, from x sets of alternate Gamma register values wherein each set corresponds to m binding points and the initial Gamma register values, a set of Gamma register values used for Gamma correction of the display module(s) as reference register values; and correcting register values of remaining (m−s) binding points based on the reference Gamma register values and the target Gamma curve to obtain a set of target Gamma register values corresponding to the m binding points;

wherein s, m, and x are all integers greater than one.

2. The method of claim 1, wherein the selecting, from x sets of alternate Gamma register values wherein each set corresponds to m binding points and the initial Gamma register values, a set of Gamma register values used for Gamma correction of the display module(s) as the reference register values comprises:

selecting, from the x sets of alternate Gamma register values, a set that is closest to the corrected Gamma values as a set of optimal Gamma register values;

using the set of optimal Gamma register values as the reference Gamma register values when a maximum deviation between the set of optimal Gamma register values and the corrected Gamma register values is smaller than a value; and using the initial Gamma register values as the reference Gamma register values when the maximum deviation between the optimal Gamma register values and the corrected Gamma register is greater than the value.

3. The method of claim 2, wherein the selecting, from the x sets of alternate Gamma register values, a set that is closest to the corrected Gamma values as a set of optimal Gamma register values comprises:

obtaining a set of original optimal Gamma register values based on the corrected Gamma register values corresponding to the s binding points; and selecting a set of alternate Gamma register values that is most frequently designated as the set of original optimal Gamma register values to be the set of optimal Gamma register values.

4. The method of claim 1, wherein the selecting, from x sets of alternate Gamma register values wherein each set corresponds to m binding points and the initial Gamma register values, a set of Gamma register values used for Gamma correction of the display module(s) as the reference register values further comprises:

selecting, from the x sets of alternate Gamma register values, a set which has biggest deviation from the corrected Gamma register values as a worst Gamma register values; and replacing the worst Gamma register values with the target Gamma register values and storing the target Gamma register values.

5. The method of claim 4, wherein the selecting, from the x sets of alternate Gamma register values, a set which has biggest deviation from the corrected Gamma register values as a worst Gamma register values comprises:

obtaining a set of original worst Gamma register values based on the corrected Gamma register values corresponding to the s binding points; and selecting a set of alternate Gamma register values that is most frequently designated as the set of original worst Gamma register values to be the set of worst Gamma register values.

6. The method of claim 1, wherein the s binding points are selected from the first successive s binding points in the set of m binding points.

7. The method of claim 1, wherein the m binding points are divided into multiple groups, each corresponding to a different backlight brightness.

8. The method of claim 1, wherein the initial Gamma register values are fixed values, or the target Gamma register values are used as the initial Gamma register values for the Gamma correction of the next display module.

9. A display module Gamma correction device, comprising:

a storage unit configured to store m binding point values of a grayscale corresponding to a set of initial Gamma register values and x sets of alternate Gamma register values;

a Gamma correction unit configured to obtain corrected Gamma register values corresponding to binding points of a grayscale by correcting register values of s binding points selected from the set of m binding points of the grayscale based on a group of initial Gamma register values that correspond to the m binding points and a Gamma curve; and a reference Gamma register value selecting unit configured to select, from x sets of alternate Gamma register values wherein each set corresponds to m binding points and the initial Gamma register values, a set of Gamma register values used for Gamma correction of the display module(s) as reference register values;

wherein said Gamma correction unit further configured to perform Gamma correction on the remaining (m s) binding points based on the reference Gamma register values and the target Gamma curve so as to obtain a set of target Gamma register values corresponding to the m binding points;

and wherein s, m, and x are all integers greater than one.

10. The Gamma correction device of claim 9, wherein the Gamma correction unit is further configured to perform:

Selecting, from the x sets of alternate Gamma register values, a set that is closest to the corrected Gamma values as a set of optimal Gamma register values;

using the set of optimal Gamma register values as reference Gamma register values when a maximum deviation between the set of optimal Gamma register values and the corrected Gamma register values is smaller than a value; and using the initial Gamma register values as the reference Gamma register values when the maximum deviation between the optimal Gamma register values and the corrected Gamma register is greater than the value.

11. The Gamma correction device of claim 9, wherein the reference Gamma register value selection unit is further configured to perform:

obtaining a set of original optimal Gamma register values based on the corrected Gamma register values corresponding to the s binding points;

selecting a set of alternate Gamma register values that is most frequently designated as the set of original optimal Gamma register values to be the set of optimal Gamma register values;

selecting from the x sets of Gamma register values the set that deviates most from the Gamma register values being corrected to be the worst Gamma register values; and replacing the worst Gamma register values with a set of target Gamma register values obtained after performing Gamma correction.

12. The Gamma correction device of claim 11, wherein the selecting the optimal Gamma register values and the worst Gamma register values further comprises:

obtaining a set of original worst Gamma register values based on the correct Gamma register values corresponding to the s binding points; and selecting a set of alternate Gamma register values that is most frequently designated as the original worst Gamma register values to be the set of worst Gamma register values.

13. The Gamma correction device of claim 9, wherein the s binding points are selected from the first successive s binding points in the set of m binding points.

14. The Gamma correction device of claim 13, wherein the m binding points are further divided into multiple groups, each corresponding to a different backlight brightness.

15. The Gamma correction device of claim 14, wherein the initial Gamma register values are fixed values, or the target Gamma register values are used as the initial Gamma correction of the next display module.

16. A display module manufacturing system comprising the Gamma correction device according to claim 15, the system further comprising:

a signal generator configured to generate drive signals to drive display modules; and an optical testing system configured to measure light generated by the display modules.

17. The system of claim 16, wherein the display modules are active matrix organic light-emitting diode (AMOLED)

display modules comprising a plurality of thin-film transistors (TFTs), and the drive signals are configured to adjust drive voltages of the TFTs.

18. The system of claim 17, wherein the set of reference Gamma register values include different values for different display modules among the plurality of display modules.

19. The system of claim 18, wherein the system is an assembly line for the display modules.

20. A non-transitory computer-readable storage medium having instructions stored therein, wherein when said instructions are executed by a Gamma correction device, said instructions cause said Gamma correction device to perform a Gamma correction method according to claim 1.

* * * * *